US010323870B2

(12) United States Patent
Douglas et al.

(10) Patent No.: US 10,323,870 B2
(45) Date of Patent: Jun. 18, 2019

(54) OPTIMIZING LIQUID TEMPERATURE AND LIQUID PRESSURE IN A MODULAR OUTDOOR REFRIGERATION SYSTEM

(71) Applicant: Heatcraft Refrigeration Products LLC, Stone Mountain, GA (US)

(72) Inventors: Jonathan Douglas, Lewisville, TX (US); Umesh Gokhale, Irving, TX (US)

(73) Assignee: Heatcraft Refrigeration Products LLC, Stone Mountain, GA (US)

( * ) Notice: Subject to any disclaimer, the term of this patent is extended or adjusted under 35 U.S.C. 154(b) by 154 days.

(21) Appl. No.: 15/205,477

(22) Filed: Jul. 8, 2016

(65) Prior Publication Data

US 2017/0292743 A1 Oct. 12, 2017

Related U.S. Application Data

(60) Provisional application No. 62/318,889, filed on Apr. 6, 2016.

(51) Int. Cl.
*F25B 49/02* (2006.01)
*F25B 13/00* (2006.01)
(Continued)

(52) U.S. Cl.
CPC ..... *F25B 49/02* (2013.01); *F25B 5/02* (2013.01); *F25B 13/00* (2013.01); *F25B 41/04* (2013.01); *F25B 49/022* (2013.01); *F25B 2400/075* (2013.01); *F25B 2600/19* (2013.01); *F25B 2600/2513* (2013.01); *F25B 2600/2515* (2013.01); *F25B 2700/195* (2013.01);
(Continued)

(58) Field of Classification Search
CPC ..... F25B 49/02; F25B 41/04; F25B 49/022
See application file for complete search history.

(56) References Cited

U.S. PATENT DOCUMENTS 6,105,380 A * 8/2000 Yokomachi ..... F04B 27/1804 62/114
2006/0048531 A1* 3/2006 Eisenhour ..... B60H 1/3208 62/228.3
(Continued)

FOREIGN PATENT DOCUMENTS

DE 102013004786 9/2014
WO WO 2015174054 11/2015

OTHER PUBLICATIONS

European Patent Office Extended Search Report in European Application No. 17165347.0-1602, dated Sep. 25, 2017, 8 pages.

*Primary Examiner* — Ljiljana V. Ciric
*Assistant Examiner* — Alexis K Cox
(74) *Attorney, Agent, or Firm* — Baker Botts L.L.P.

(57) ABSTRACT

A refrigeration system includes a valve and a controller. The valve is configured to control the flow of refrigerant into an evaporator, the refrigerant having an associated liquid setting comprising a temperature and a pressure at which the refrigerant flows through the valve. The controller is operable to adjust the liquid setting, the adjusted liquid setting comprising a temperature and a pressure selected to improve energy efficiency under conditions currently being experienced by the refrigeration system, wherein the controller is operable to adjust the temperature and the pressure simultaneously such that the adjustment does not interfere with operation of the valve.

7 Claims, 11 Drawing Sheets

(51) Int. Cl.
*F25B 41/04* (2006.01)
*F25B 5/02* (2006.01)

(52) U.S. Cl.
CPC ..... *F25B 2700/1931* (2013.01); *F25B 2700/2106* (2013.01); *F25B 2700/21152* (2013.01); *F25B 2700/21163* (2013.01)

(56) References Cited

U.S. PATENT DOCUMENTS

| | | | |
|---|---|---|---|
| 2007/0125106 | A1 | 6/2007 | Ishikawa et al. |
| 2015/0059373 | A1 | 3/2015 | Maiello et al. |

* cited by examiner

OPTIMIZING LIQUID TEMPERATURE AND LIQUID PRESSURE IN A MODULAR OUTDOOR REFRIGERATION SYSTEM

RELATED APPLICATIONS

This application claims the benefit of U.S. Provisional Application No. 62/318,889, filed Apr. 6, 2016 and entitled "Modular Outdoor Refrigeration System," which is hereby incorporated by reference in its entirety.

TECHNICAL FIELD

This disclosure relates generally to a refrigeration system, specifically a modular outdoor refrigeration system.

BACKGROUND

Refrigeration systems can be used to regulate the environment within an enclosed space. Various types of refrigeration systems, such as residential and commercial, may be used to maintain cold temperatures within an enclosed space such as a refrigerated case. To maintain cold temperatures within refrigerated cases, refrigeration systems must control the temperature and pressure of the refrigerant as it moves through the refrigeration system.

Each refrigeration system typically includes at least one controller that directs the operation of the refrigeration system. The controller can direct the operation of one or more components of the refrigeration system, such as the condenser and compressors, to maintain cold temperatures within refrigerated cases.

SUMMARY OF THE DISCLOSURE

According to one embodiment, a refrigeration system includes a valve and a controller. The valve is configured to control the flow of refrigerant into an evaporator, the refrigerant having an associated liquid setting comprising a temperature and a pressure at which the refrigerant flows through the valve. The controller is operable to adjust the liquid setting, the adjusted liquid setting comprising a temperature and a pressure selected to improve energy efficiency under conditions currently being experienced by the refrigeration system, wherein the controller is operable to adjust the temperature and the pressure simultaneously such that the adjustment does not interfere with operation of the valve.

Certain embodiments may provide one or more technical advantages. For example, an embodiment of the present disclosure may result in more efficient operation of refrigeration system. As another example, an embodiment of the present disclosure may provide the refrigeration system with an optimal liquid setting. Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Figure 1:
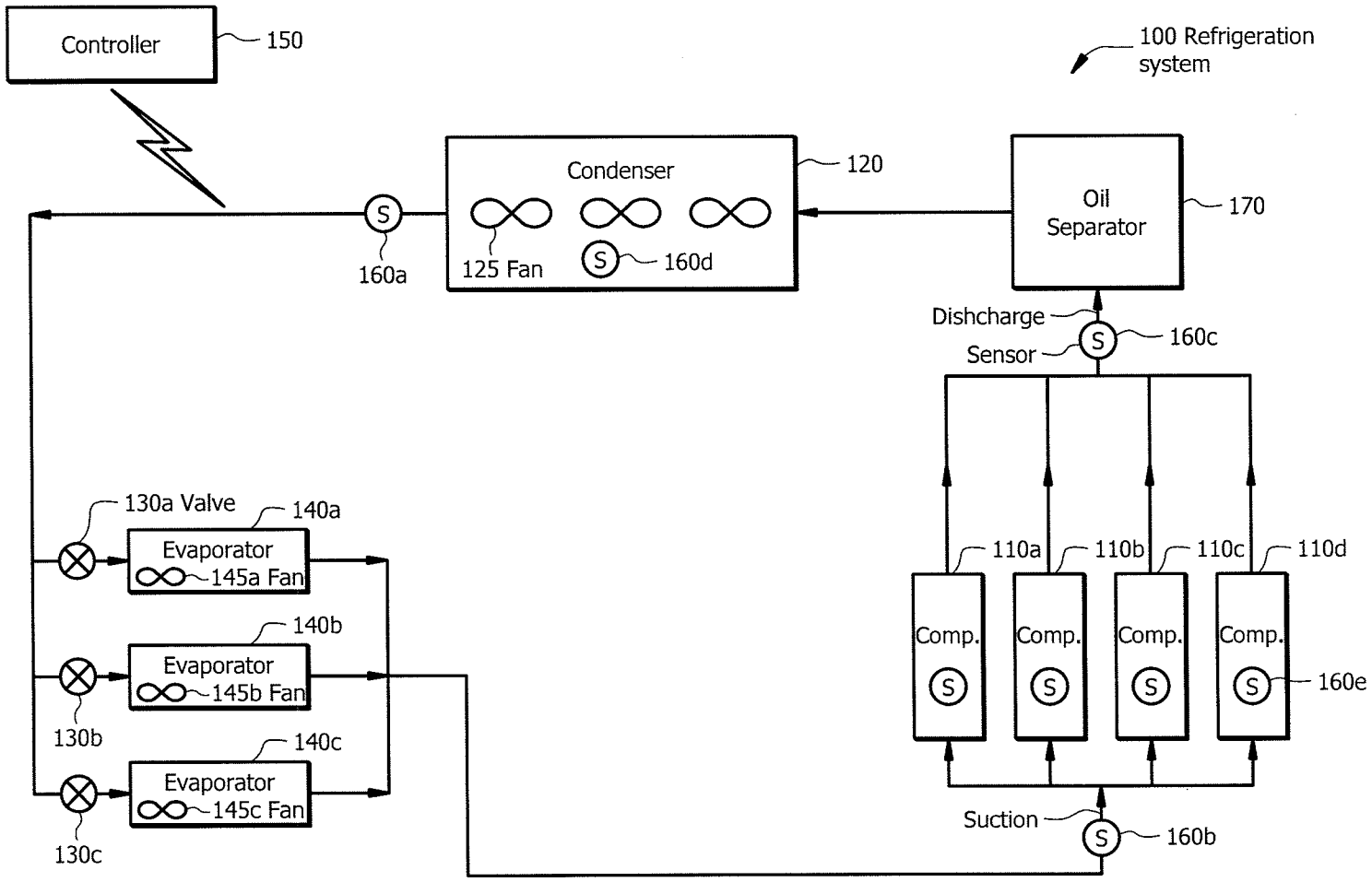
FIG. 1 illustrates an example refrigeration system according to certain embodiments of the present disclosure.

Embodiments of the present disclosure and its advantages are best understood by referring to FIGS. 1 through 13 of the drawings, like numerals being used for like and corresponding parts of the various drawings.

A refrigeration system can be used to maintain cool temperatures within an enclosed space, such as a refrigerated case for storing food, beverages, etc. This disclosure contemplates a configuration of a refrigeration system that may provide various energy-efficient benefits. As an example, certain embodiments provide for optimizing power usage. As another example, certain embodiments provide optimal liquid pressure and temperature settings to a valve controlling an evaporator. As yet another example, certain embodiments provide optimal compressor staging. This disclosure also contemplates a refrigeration system that can detect possible component defects or deficiencies. This disclosure also contemplates methods of determining whether a refrigeration system is meeting its control objectives.

Generally, a refrigeration system 100 includes at least one compressor 110, a condenser 120, at least one valve 130, and one or more evaporators 140. Refrigeration system 100 continuously circulates refrigerant through it to maintain a cold environment for an enclosed space such as a refrigerated case. Typically, liquid refrigerant is added to refrigeration system 100, and the liquid refrigerant changes phases as it undergoes changes in temperature and pressure as it moves through refrigeration system 100.

In some embodiments, refrigeration system 100 includes a compressor 110. Refrigeration system 100 may include any suitable number of compressors 110. For example, as depicted in FIG. 1, refrigeration system 100 includes four compressors 110*a-d*. Compressors 110 may vary by design. For example, some compressor designs may be more energy efficient than other compressor designs. As another example, some compressors may have modular capacity (i.e., capability to vary capacity). Herein, compressor capacity may refer to the capacity of refrigerant vapor that a compressor will displace based on the operating conditions of the compressor. Compressors may also vary by capacity. For example, compressors 110*a* and 110*b* may have a capacity of 18 kBTU/hr and compressors 110*c* and 110*d* may have a capacity of 41 kBTU/hr. In such an example, the refrigeration rack would have a total capacity of 118 kBTU/hr.

In some embodiments, compressors 110 may include sensors 160. For example, as depicted in FIG. 1, compressors 110 may be associated with sensor 160*b*, 160*c*, and 160*e*. These compressor sensors 160 may be operable to sense information about the compressors 110 such as suction pressure, suction temperature, discharge pressure and actual current. Because compressors 110 may vary by design or capacity, the information sensed by each compressor sensor 160 may be different. For example, sensor 160*e* of compressor 110*a* may sense a first current and sensor 160*e* of compressor 110*b* may sense a second current. This disclosure recognizes that in some instances, such as when a compressor is not activated or selected by refrigeration system 100, compressor sensors 160 may sense a zero value associated with the suction pressure, suction temperature, discharge pressure and/or current.

In some embodiments, refrigeration system 100 includes a condenser 120. Refrigeration system 100 may include any suitable number of condensers 120. Condenser 120 may include at least one heat exchanger and at least one condenser fan 125. In some embodiments, condenser 120 includes sensors 160. For example, condenser 120 may include a sensor 160 that is configured to detect the speed of condenser fan (i.e., 160*d*).

In some embodiments, refrigeration system 100 includes a valve 130. Refrigeration system 100 may include any suitable number of valves 130. For example, in FIG. 1, refrigeration system 100 has three valves 130*a-c*. Generally, valves 130 control the flow of refrigerant to each evaporator 140. In some embodiments, a single valve 130 controls the flow to a single evaporator 140. For example, in FIG. 1, valve 130*a* controls the refrigerant flow to evaporator 140*a*, valve 130*b* controls the refrigerant flow to evaporator 140*b*, and valve 130*c* controls the refrigerant flow to evaporator 140*c*.

In some embodiments, refrigeration system 100 includes one or more evaporators 140. Evaporators 140 may be included in any suitable component of refrigeration system 100 that provides cooling to an enclosed space. For example, evaporator 140 may be included in a refrigerated display case, a unit cooler, a walk-in cooler, a deli case, a unit cooler in a deep freezer, etc. Refrigeration system 100 may include any suitable number of evaporators 140. For example, as depicted in FIG. 1, refrigeration system 100 includes three evaporators 140*a-c*. Evaporator 140 may be associated with at least one heat exchanger and at least one fan 145.

In some embodiments, refrigeration system 100 includes at least one controller 150 that directs the operations of refrigeration system 100. Controller 150 may be communicably coupled to one or more components of refrigeration system 100. For example, controller 150 may be configured to receive data sensed by sensors 160. As another example, controller 150 may be configured to receive data of refrigeration system 100.

Controller 150 may be configured to provide instructions to one or more components of refrigeration system 100. Controller 150 may be configured to provide instructions via any appropriate communications link (e.g., wired or wireless) or analog control signal. As depicted in FIG. 1, controller 150 is configured to wirelessly communicate with components of refrigeration system 100. For example, in response to receiving an instruction from controller 150, speed of condenser fan 125 may increase or decrease. As another example, in response to receiving an instruction from controller 150, compressor 110*a* may increase discharge pressure. An example of controller 150 is further described below with respect to FIG. 2. In some embodiments, controller 150 includes or is a computer system.

Some components of refrigeration system 100 may be arranged on a refrigeration rack on the roof of a building. In some embodiments, refrigeration rack may include compressors 110 and condenser 120. In some other embodiments, refrigeration rack may also include an oil separator 170.

Refrigeration system 100 may also include one or more sensors 160. For example, the refrigeration rack may include a temperature sensor 160 configured to sense data related to outdoor temperature. As another example, one or more sensors may be configured to sense data related to liquid temperature and pressure leaving condenser 120 (e.g., sensor 160*a*). Sensors 160 may also be configured to sense data related to suction pressure into compressor 110 (e.g., sensor 160*b*), data related to discharge pressure out of compressor 110 (e.g., sensor 160*c*), and/or data related to speed of condenser fan 125 (e.g., sensor 160*d*). As another example, a sensor may be configured to sense data related to current and capacity of compressors 110 (e.g., sensor 160*e*). Although this disclosure describes and depicts specific types of sensors, refrigeration system 100 may include any other type and any suitable number of sensors 160.

Figure 2:
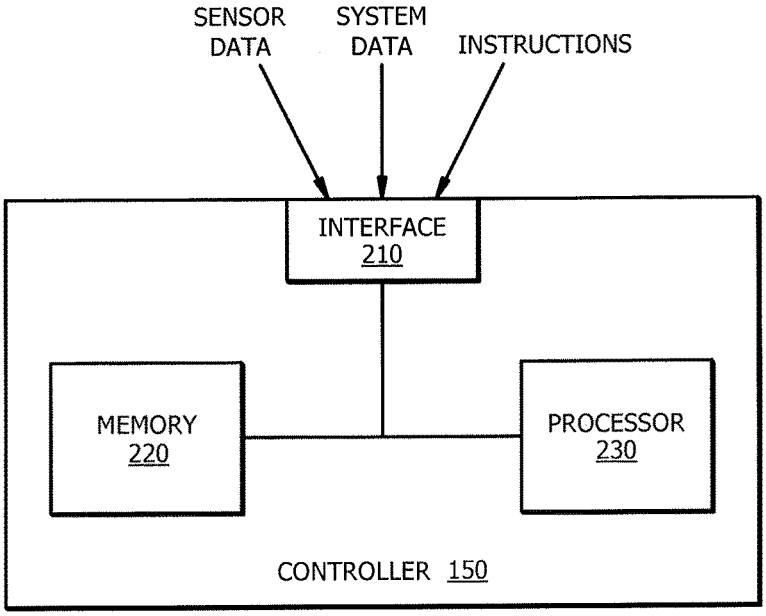
FIG. 2 illustrates an example controller of a refrigeration system, according to certain embodiments of the present disclosure.

FIG. 2 illustrates an example controller 150 of refrigeration system 100, according to certain embodiments of the present disclosure. Controller 150 may comprise one or more interfaces 210, memory 220, and one or more processors 230. Interface 210 receives input (e.g., sensor data or system data), sends output (e.g., instructions), processes the input and/or output, and/or performs other suitable operation. Interface 210 may comprise hardware and/or software.

Processor 230 may include any suitable combination of hardware and software implemented in one or more modules to execute instructions and manipulate data to perform some or all of the described functions of controller 150. In some embodiments, processor 230 may include, for example, one or more computers, one or more central processing units (CPUs), one or more microprocessors, one or more applications, one or more application specific integrated circuits (ASICs), one or more field programmable gate arrays (FPGAs), and/or other logic.

Memory (or memory unit) 220 stores information. Memory 220 may comprise one or more non-transitory, tangible, computer-readable, and/or computer-executable storage media. Examples of memory 220 include computer memory (for example, Random Access Memory (RAM) or Read Only Memory (ROM)), mass storage media (for example, a hard disk), removable storage media (for example, a Compact Disk (CD) or a Digital Video Disk (DVD)), database and/or network storage (for example, a server), and/or other computer-readable medium.

This disclosure recognizes optimizing power usage to improve the energy efficiency of a refrigeration system. Generally, the refrigerant supplied to evaporators should be maintained within pre-determined temperature and pressure ranges. The pre-determined temperature and pressure ranges are maintained by adjusting the discharge pressure of the compressors and the condenser fan speed. In typical refrigeration systems, the condenser fan speed is adjusted in order to maintain a constant temperature difference (TD) between the outside air and refrigerant.

Commonly, the standard TD is 15° Fahrenheit (F). In typical refrigeration systems, the speed of condenser fan is continually adjusted to maintain the condenser TD, and the discharge pressure of the compressors is continually adjusted to maintain the refrigerant supplied to the evaporators within the pre-determined temperature and pressure ranges. As such, the condenser fan (e.g., fan 125) and compressors (e.g., compressors 110*a*-110*d*) contribute to high power usage.

These and other problems of typical refrigeration systems may be reduced or eliminated by using a refrigeration system that uses an optimal TD setpoint. The optimal TD setpoint may be continually adjusted to an optimal setting based on the current compressor loading conditions and/or outdoor temperature conditions. As an example, under certain compressor loading conditions and/or outdoor temperature conditions, it may be more power efficient to increase the condenser fan speed (thereby increasing condenser fan power) in order to reduce compressor power by a greater extent. Under these conditions, the TD setpoint can be adjusted to cause the condenser fan speed to increase. As another example, under other compressor loading conditions and/or outdoor temperature conditions, it may be more power efficient to decrease the condenser fan speed (thereby reducing fan power) and increase the compressor discharge pressure. The corresponding increase in discharge pressure will increase compressor power, but to a lesser extent than the decrease in fan power. Under these conditions, the TD setpoint can be adjusted to cause the condenser fan speed to decrease.

Figure 3A:
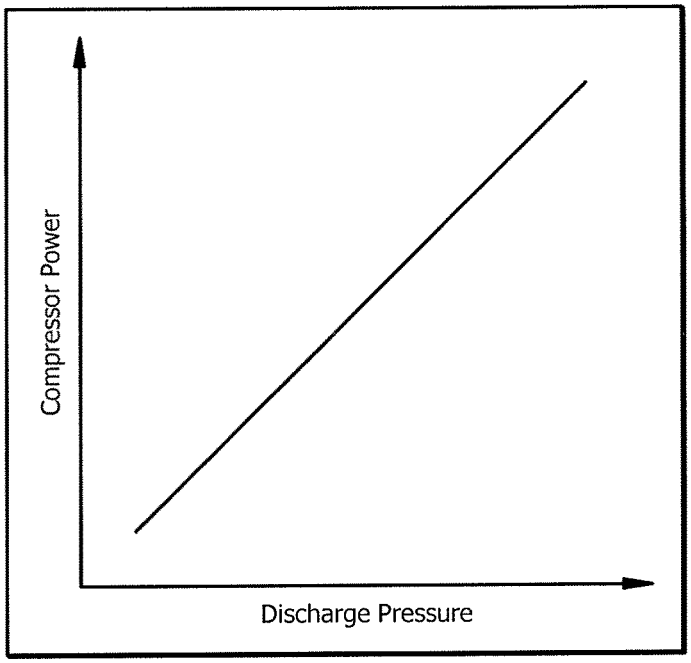
FIGS. 3A-3D are graphical representations of the relationships between various components, and power usage thereof, of the example refrigeration system of FIG. 1, according to certain embodiments.

FIG. 3A illustrates the relationship between compressor power and discharge pressure. As depicted, discharge pressure increases as power of compressor 110 increases. In some embodiments, discharge pressure is measured using sensor 160*c*. In some embodiments, power of compressor 110 is measured using sensor 160*e*.

Figure 3B:
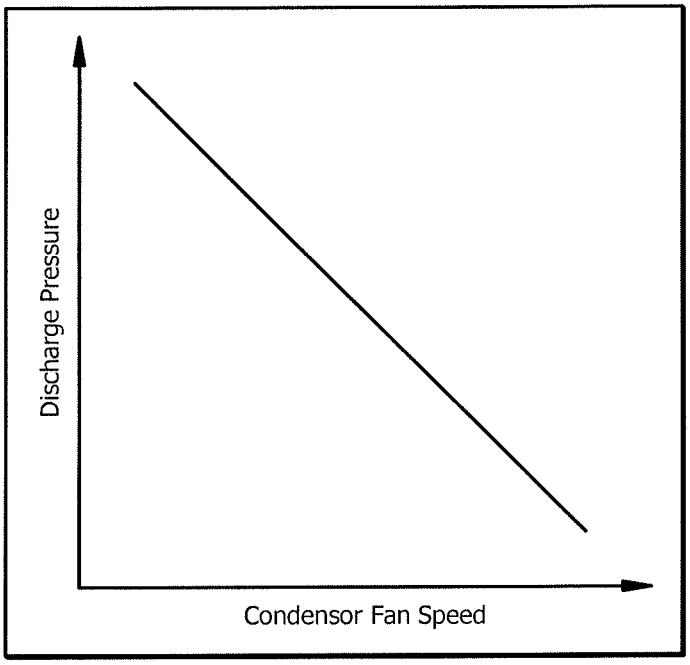

FIG. 3B illustrates the relationship between discharge pressure and condenser fan speed. As depicted, discharge pressure decreases as speed of condenser fan increases. In some embodiments, speed of condenser fan 125 is measured using sensor 160*d*.

Figure 3C:
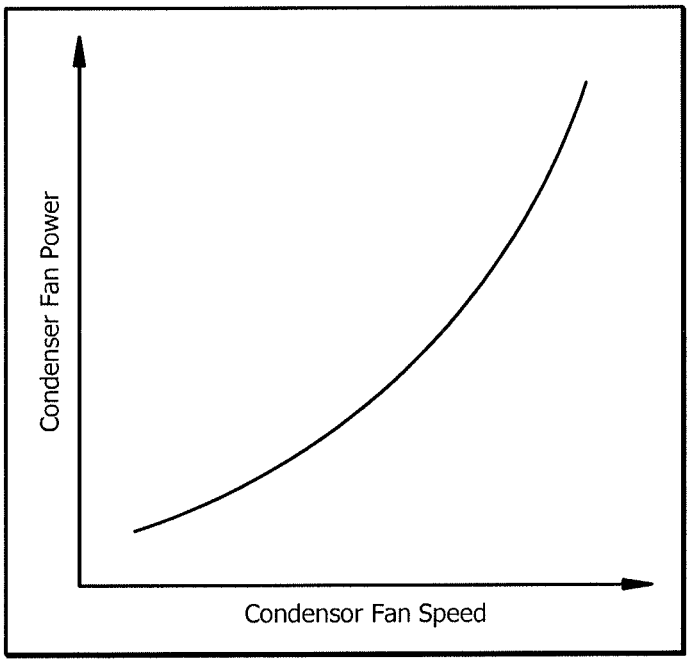

FIG. 3C illustrates the relationship between power of condenser fan and speed of condenser fan. As depicted, power of condenser fan increases as the speed of condenser fan increases. In some embodiments, power of condenser fan is measured using sensor 160*d*.

Figure 3D:
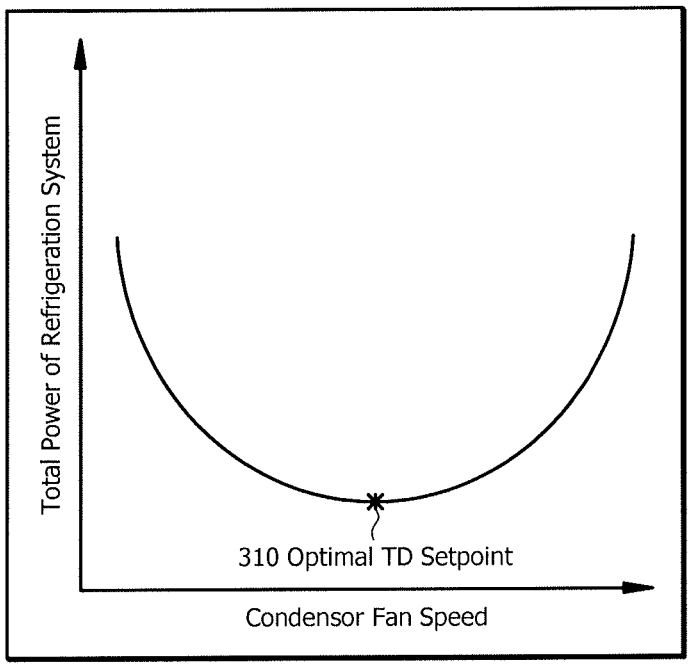

Based on data from FIGS. 3A-3C, FIG. 3D may be constructed to represent the relationship between total power usage of refrigeration system 100 and speed of condenser fan 125. As depicted, total power of refrigeration system 100 is high when the speed of condenser fan is low (i.e., when compressor 110 is discharging refrigerant at high pressures). On the other hand, total power of refrigeration system 100 is also high when the speed of condenser fan is high. FIG. 3D illustrates that the most efficient operation of refrigeration system 100 occurs when the compressors 110 and condenser fan 125 operate jointly. As such, this disclosure recognizes using an optimal TD setpoint that maximizes the efficiency of compressors 110 and condenser fan 125. As depicted in FIG. 3D, maximum power efficiency of refrigeration system 100 is achieved at optimal TD setpoint 310.

In some embodiments, the optimal TD setpoint is calculated by controller 150. The optimal TD setpoint may vary based on the temperature of the environment (e.g., outdoor temperature). The optimal TD setpoint may also vary based on rack loading. This disclosure recognizes that certain benefits may result by achieving the optimal TD setpoint when the increase in fan power is less than the decrease in compressor power, or alternatively, when the increase in compressor power is less than the decrease in fan power.

In some embodiments, controller 150 of refrigeration system 100 calculates the optimal TD setpoint. Optimal TD setpoint values may be calculated as a function of outdoor temperature and compressor loading. Because the optimal TD setpoint is dependent on outdoor temperature and compressor loading, the optimal TD setpoint may change over time. In some embodiments, optimal TD setpoints can be predetermined by the manufacturer and uploaded to memory 220 of controller 150 of refrigeration system 100.

In other embodiments, controller 150 adjusts settings as it operates thereby creating feedback regarding total power usage. For example, controller 150 may create a new setting wherein it increases the speed of condenser fan 125 resulting in an increase in power to condenser fan 125. If this increase in power to condenser fan 125 results in a significant decrease in power to compressor(s) 110, the total power consumption of refrigeration system 100 may be reduced. Speed of condenser fan 125 may be measured by sensor 160*d* and discharge pressure of compressor 110 may be measured by sensor 160*c*. If this new setting results in lower power consumption, the new setting may be saved to memory 220 of controller 150. In some embodiments, controller 150 may override an optimal TD setpoint preloaded by the manufacturer.

Figure 8:
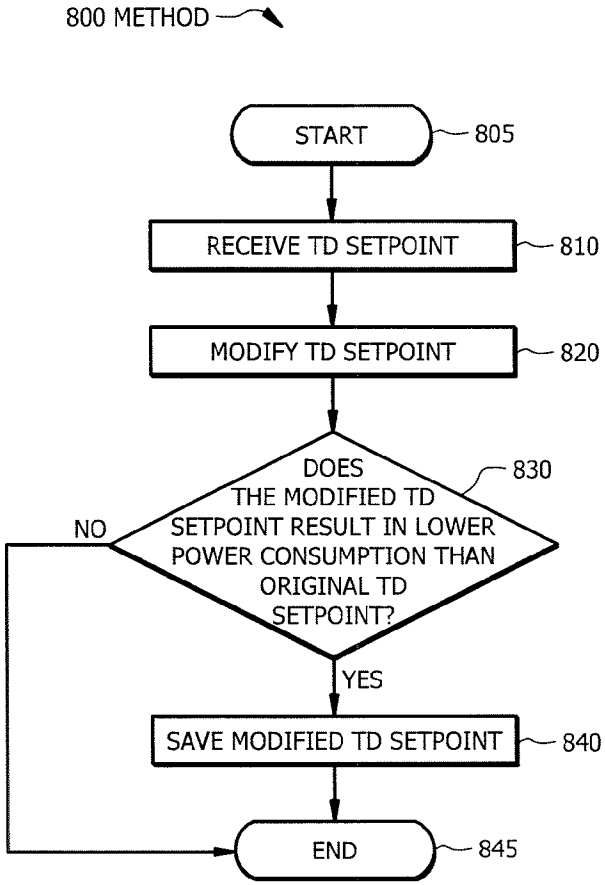
FIG. 8 is a flow chart illustrating a method of optimizing power usage in the refrigeration system of FIG. 1, according to one embodiment of the present disclosure.

FIG. 8 is directed to a method of optimizing power usage in a refrigeration system. The refrigeration system may be refrigeration system 100 of FIG. 1. A controller such as described with respect to FIGS. 1 or 2 may be used to perform the method of FIG. 8. The method of FIG. 8 may represent an algorithm that is stored on computer readable medium, such as a memory of a controller (e.g., the memory 220 of FIG. 2).

Turning now to FIG. 8, the method 800 begins at step 805. At step 810, the refrigeration system receives a temperature difference (TD) setpoint indicating a desired temperature difference between outside air and refrigerant. For example, the TD setpoint may be received from memory 220 of controller 150. In some embodiments, the method 800 continues to step 820.

At step 820, the refrigeration system modifies the TD setpoint based on conditions currently being experienced by the system. In some embodiments, the conditions being experienced by the refrigeration system may comprise an outdoor temperature and/or the loading conditions of the compressor. For example, the conditions may be determined based on information received from sensors 160. The modified TD setpoint may be selected to cause a decrease in total power consumption of the refrigeration system. Total power consumption may comprise the power consumed by a compressor to yield a discharge pressure and the power consumed by a condenser fan to operate a fan speed. In some embodiments, modifying the TD setpoint causes the power consumed by the compressor to decrease more than the power consumed by the condenser fan increases. In other embodiments, modifying the TD setpoint causes the power consumed by the condenser fan to decrease more than the power consumed by the compressor increases. As such, in some embodiments, modifying the setpoint results in a decrease in the system power consumption. In some embodiments, the method continues to step 830.

At a decision step 830, the refrigeration system determines whether the total power consumption associated with the modified TD setpoint is lower than the total power consumption associated with the original TD setpoint. If the refrigeration system determines that the total power consumption associated with the modified TD setpoint is greater than the total power consumption associated with the original TD setpoint, the method 800 may continue to end step 845. Alternatively, if the refrigeration system determines that the total power consumption associated with the modified TD setpoint is lower than the total power consumption associated with the original TD setpoint, the method 800 may continue to step 840.

At step 840, the refrigeration system saves the modified TD setpoint as an optimal TD setpoint for the conditions currently being experienced by the refrigeration system in response to feedback indicating that the modified TD setpoint caused the total power consumption to decrease. For example, in response to determining that the modified TD setpoint resulted in a decrease in total power consumption of the refrigeration system, the refrigeration system may save the modified TD setpoint for future use when the conditions experienced by the refrigeration system reoccur. In some embodiments, the method continues to end step 845.

This disclosure also recognizes improving the energy efficiency of a refrigeration system by optimizing the liquid temperature and pressure of the refrigerant circulating through the refrigeration system. In most conventional refrigeration systems, the liquid outlet temperature from the refrigeration rack is controlled to a constant temperature even though the refrigeration rack may be capable of running lower temperatures. This disclosure recognizes that running lower temperatures through the refrigeration rack may provide various benefits such as improving the energy efficiency of the refrigeration rack. Typically, conventional refrigeration systems do not run lower temperatures through the refrigeration rack because adjusting the liquid outlet temperature may interfere with the position of the valve, thereby causing unstable operation of the refrigeration system. This disclosure contemplates a configuration of a refrigeration system that may provide optimal liquid pressure and temperature settings to a valve controlling an evaporator.

Generally, the liquid outlet temperature from the refrigeration rack is controlled to a constant temperature (e.g., 50° F.) even though efficiency of the refrigeration rack may be improved by running lower temperatures. As described above, lower temperatures are generally not run because lowering the liquid temperature interferes with operation of valve 130. For example, decreasing the temperature of the refrigerant causes an increase in enthalpy change which in turn decreases the mass flow required by evaporator(s) 140 and causes valve(s) 130 to close. Valves 130 operating near the fully closed position may cause unstable operation of refrigeration system 100. Accordingly, there is a need for a refrigeration system that permits refrigerant to be run through refrigeration system 100 at a lower temperature without interfering with the operation of valve 130. Such a system may be associated with various energy-efficient benefits.

This disclosure recognizes that maintaining the enthalpy of refrigeration system 100 holds valve 130 in a constant position (i.e., does not interfere with the operation of valve 130). This disclosure also recognizes that decreasing liquid pressure results in a decrease in pressure difference across valve 130 which in turn decreases the actual mass flow and causes valve 130 to open to increase the flow to the required mass flow. Thus, this disclosure recognizes controlling the liquid temperature and liquid pressure to maintain the enthalpy of refrigeration system 100.

In some embodiments, refrigeration system 100 uses an optimal liquid setting. The optimal liquid setting may be a function of both the temperature and pressure of the liquid refrigerant. In some embodiments, the optimal liquid setting maintains the enthalpy of refrigeration system 100. For example, valve 130 is in position one when liquid outlet temperature is 50° F. and liquid outlet pressure is 104 pounds per square inch (PSI). In some embodiments, liquid outlet temperature and liquid outlet pressure is measured by sensor 160*a*. In other embodiments, liquid outlet temperature and liquid outlet pressure are measured using any other suitable means.

To maintain valve 130 in the same position, the temperature and pressure of liquid refrigerant are adjusted simultaneously. In some embodiments, the temperature and pressure are adjusted by substantially the same proportion. For example, valve 130 remains in position one when liquid outlet temperature is 40° F. and liquid outlet pressure is 90 PSI. In some embodiments, the optimal liquid setting may improve the efficiency of refrigeration system 100.

In some embodiments, controller 150 operates refrigeration system 100 using an optimal liquid setting. Because the optimal liquid setting is dependent on temperature (e.g., the outdoor temperature), the optimal liquid setting may change over time. In some embodiments, optimal liquid settings corresponding to each temperature can be predetermined by the manufacturer and uploaded to controller 150 of refrigeration system 100. For example, controller 150 may be preloaded with information from TABLE 1 below:

TABLE 1

| Optimal Liquid Setting | Refrigerant Temperature | Refrigerant Pressure |
|---|---|---|
| 1 | 50° F. | 104 PSI |
| 2 | 40° F. | 90 PSI |
| 3 | 32° F. | 80 PSI |

In some embodiments, controller 150 may be configured to adjust liquid outlet temperature and pressure of refrigeration system 100 using feedback. For example, in response to receiving a sensed outdoor temperature, controller 150 may adjust the liquid outlet temperature and pressure values. If this new setting results in higher efficiency of refrigeration system 100, the new setting may be saved to memory 220 of controller 150. Controller 150 may be configured to run refrigeration system 100 using the optimal liquid setting that results in the highest efficiency of refrigeration system 100.

Figure 9:
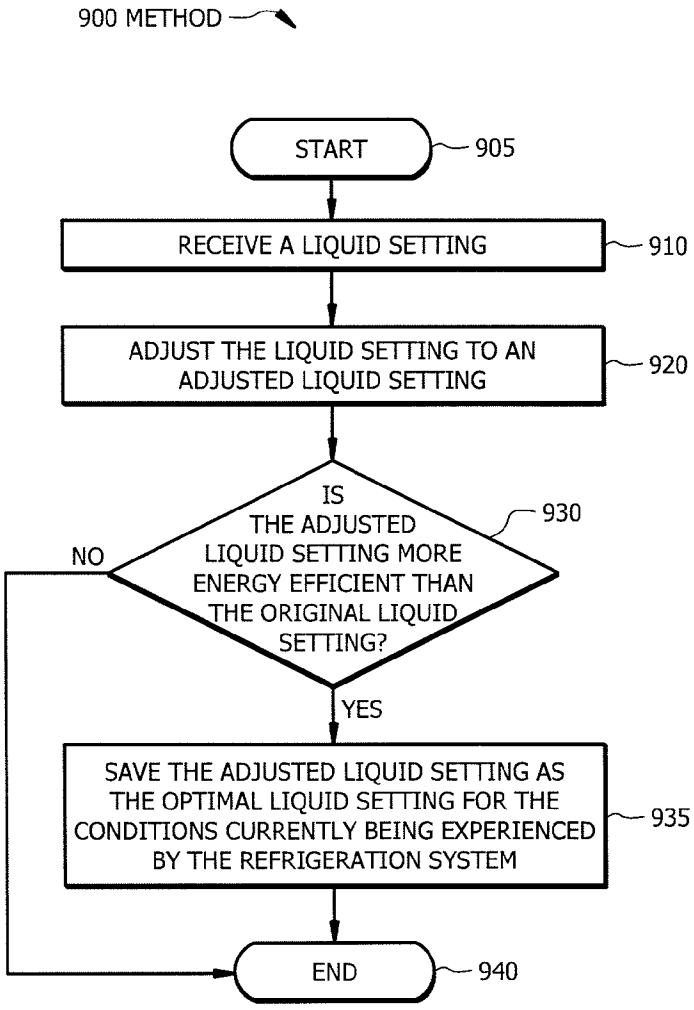
FIG. 9 is a flow chart illustrating a method of optimizing liquid pressure and temperature in the refrigeration system of FIG. 1, according to one embodiment of the present disclosure.

FIG. 9 is directed to a method of optimizing liquid pressure and temperature in a refrigeration system. The refrigeration system may be refrigeration system 100 of FIG. 1. A controller such as described with respect to FIGS. 1 or 2 may be used to perform the method of FIG. 9. The method of FIG. 9 may represent algorithms that are stored on computer readable medium, such as a memory of a controller (e.g., the memory 220 of FIG. 2).

Turning now to FIG. 9, the method 900 begins at step 905. At step 910, the refrigeration system receives a liquid setting. The liquid setting may comprise the temperature and pressure at which refrigerant flows through a valve (e.g., valve 130). In some embodiments, the temperature and pressure of the refrigerant is sensed by sensors 160. For example, the temperature and pressure of the refrigerant may be sensed by sensor 160*a*. In some embodiments, the method 900 continues to step 920.

At step 920, the refrigeration system adjusts the liquid setting to an adjusted liquid setting. The adjusted liquid setting may comprise a temperature and a pressure that improves the energy efficiency under conditions currently being experienced by the refrigeration system. In some embodiments, the conditions being experienced by the refrigeration system comprise an outdoor temperature. In some embodiments, the conditions may be determined based on information from sensors 160. The pressure associated with the adjusted liquid setting may be selected such that the valve maintains its same amount of openness. For example, the refrigeration system may select a pressure that maintains the same valve position when the temperature associated with the adjusted liquid setting is lower than the temperature associated with the original liquid setting. The temperature and pressure of the refrigerant may be adjusted simultaneously to ensure that the adjustment does not interfere with operation of the valve. The temperature and pressure of the refrigerant may be adjusted by substantially the same proportion to ensure that the adjustment does not interfere with operation of the valve. In some embodiments, the method 900 continues to step 930.

At a decision step 930, the refrigeration system determines whether the adjusted liquid setting is more energy efficient than the original liquid setting. In some embodiments, the refrigeration system makes such a determination based on feedback. If the refrigeration system determines that the adjusted liquid setting is more energy efficient than the original liquid setting, the method may continue to step 935. Alternatively, if the refrigeration system determines that the original liquid setting is more energy efficient than the adjusted liquid setting, the method may continue to an end step 945. At step 935, the refrigeration system saves the adjusted liquid setting as an optimal liquid setting for the conditions currently being experienced by the refrigeration system. In some embodiments, after saving the adjusted liquid setting as the optimal liquid setting, the method 900 may continue to end step 940.

In some embodiments, the method 900 may include one or more additional steps. For example, in some embodiments, the refrigeration system may monitor feedback indicating the energy efficiency associated with each of a plurality of liquid settings that have been applied under the conditions currently being experienced by the refrigeration system. As another example, in some embodiments, the refrigeration system may save the most energy efficient of the plurality of liquid settings as an optimal liquid setting for the conditions currently being experienced by the refrigeration system.

This disclosure also recognizes optimizing compressor staging in a refrigeration system to improve energy efficiency. Traditionally, compressors are operated in stages such that each compressor is operated to its maximum capacity before another compressor is operated. Although this traditional staging may be sufficient to maintain cool temperatures in the enclosed space, it does not account for energy efficiency. In most conventional refrigeration systems, compressors are configured to operate in stages as the system load increases (i.e., compressors are configured to operate sequentially to their maximum capacity). For example, if refrigeration system 100 includes four compressors (e.g., 110*a*, 110*b*, 110*c*, and 110*d*), each having a maximum capacity of 18 kBTU/hr, and the system load is 24 kBTU/hr, system 100 may operate 110*a* to its maximum capacity (i.e., 18 kBTU/hr) and then operate 110*b* to achieve the remainder of the load (i.e., 6 kBTU/hr). However, this traditional operation of refrigeration system 100 does not account for efficiency. For example, compressors 110*a* and 110*b* may not be the most efficient combination of compressors to meet the system load. Accordingly there is a need for a refrigeration system operable to determine the most efficient combination of compressors to meet the load.

In some embodiments, refrigeration system 100 may determine the most efficient combination of compressors 110 to meet the system load. Refrigeration system 100 may be configured to receive information associated with the system load and information associated with compressors 110. In some embodiments, refrigeration system 100 receives this information from sensors (e.g., 160*e*).

In some embodiments, controller 150 uses the system load and compressor information to determine the most efficient combination of compressors 110. For example, in some embodiments, system 100 may determine that compressors 110 operate most efficiently when the 24 kBTU/hr system load is distributed equally between compressors 110*a*, 110*b*, 110*c*, and 110*d*. In other embodiments, system 100 may determine that compressors 110 operate most efficiently when the 24 kBTU/hr system load is distributed to the most efficiently operating compressors (e.g., 110*a* and 110*d*). In other embodiments, system 100 may determine that compressors 110 operate most efficiently when the 24 kBTU/hr system load is distributed to as follows: 18 kBTU/hr to 110*a*, 3 kBTU/hr to 110*b*, and 3 kBTU/hr to 110*c*. Although this disclosure describes specific variations of compressor 110 combinations, this disclosure contemplates any combination of compressors 110 that results in increased energy efficiency.

Information associated with compressors may include data regarding model name, model number, total capacity, efficiency, portability, drive system, type (e.g., modular, reciprocating, screw, rotary, centrifugal). Although specific types of information associated with compressors has been described, this disclosure contemplates controller 150 may use any information associated with compressors 110 that results in determining the most efficient combination of compressors 110. In some embodiments, information associated with compressors 110 may be loaded into memory 220 of controller 150. For example, manufacturer may upload information regarding compressor models in memory 220 of controller 150. In other embodiments, controller 150 is configured to identify information associated with compressors (e.g., using sensors 160).

In some embodiments, controller 150 uses a data map to determine the most efficient combination of compressors. In some embodiments, data map is predetermined by manufacturer based on information associated with compressors 110. Data map may provide information to controller 150 that permits controller 150 to determine which compressors 110 to operate at any given time. In some embodiments, data map may be uploaded to memory 220 of controller 150 by manufacturer.

In some embodiments, data map may be edited or updated. For example, data map may be updated to reflect that compressor 110*a* is operating below performance expectations. In some embodiments, controller 150 updates data map based on its identification of changes to compressors 110 (e.g., using sensors 160). In other embodiments, memory 220 of controller 150 is manually updated to reflect such changes.

In some embodiments, controller 150 uses feedback to determine the most efficient operation of compressors 110. In doing such, controller 150 may operate compressors 110 in various combinations and measure efficiency levels at each combination. If a particular combination of compressors 110 results in increased efficiency, controller 150 may save this combination setting into memory 220 for future use.

An advantage of certain embodiments may allow for deploying new refrigeration systems in a cost effective manner. For example, energy efficient compressors tend to be more expensive to purchase but less expensive to operate than energy inefficient compressors. Refrigeration system 100 could be planned to include a sufficient number of energy efficient compressors to handle the typical demand. Refrigeration system 100 could further include additional inefficient compressors that would not be needed to handle the typical demand, but could be used to provide extra capacity in the event that demand is unusually high. The optimized compressor staging may be configured so that the most efficient compressors are used first and the less efficient compressors are rarely used (e.g., only in the event that the efficient compressors cannot meet the demand on their own).

Figure 10:
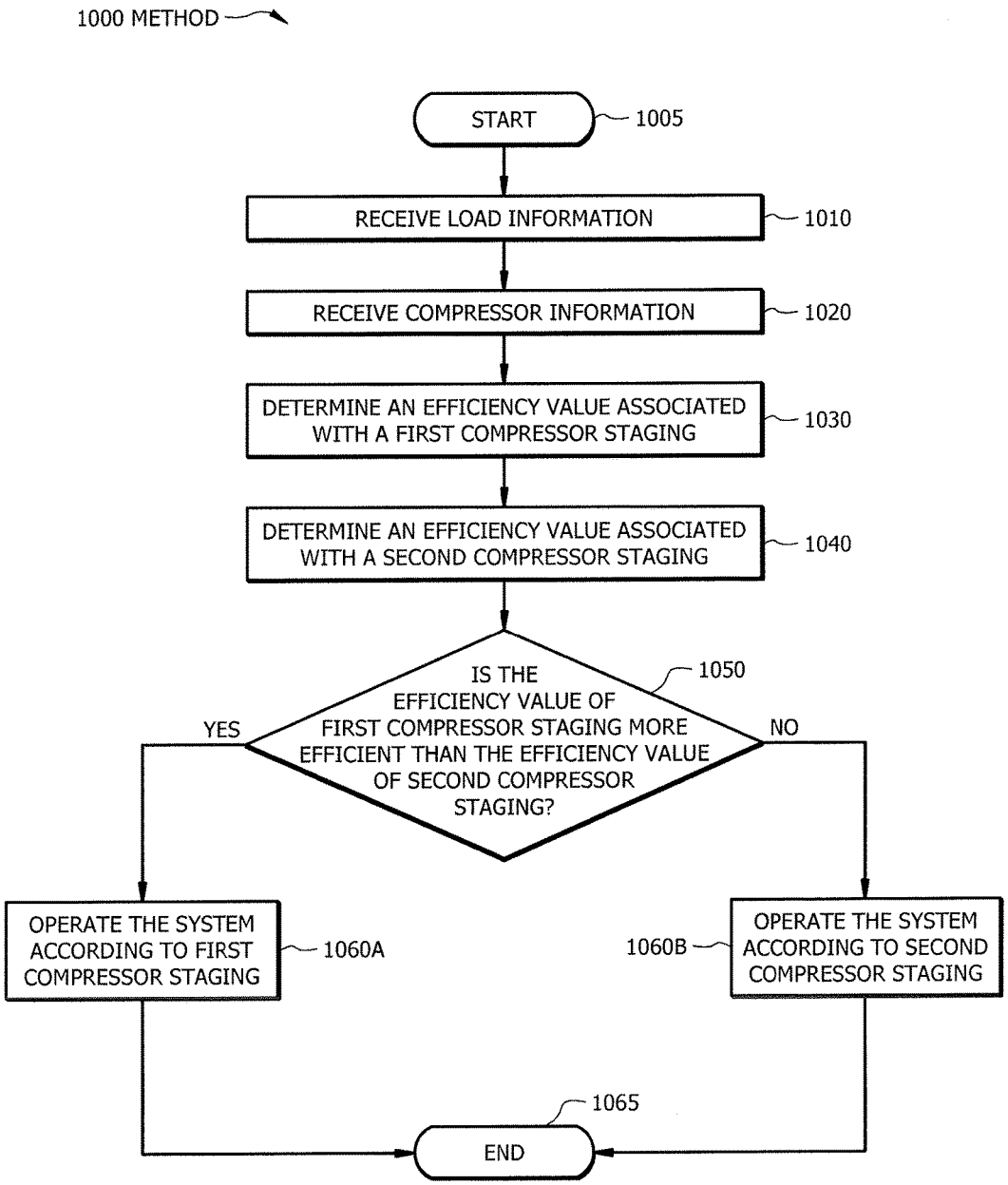
FIG. 10 is a flow diagram illustrating an example method of optimizing compressor staging in the refrigeration system of FIG. 1 according to one embodiment of the present disclosure.

FIG. 10 is directed to a method of optimizing compressor staging in a refrigeration system. The refrigeration system can be the refrigeration system of FIG. 1. A controller such as described with respect to FIGS. 1 or 2 may be used to perform the method of FIG. 10. The method of FIG. 10 may represent an algorithm that is stored on a computer readable medium, such as a memory of a controller (e.g., the memory 220 of FIG. 2).

The method 1000 begins at step 1005. At step 1010, the refrigeration system receives information associated with a load of the refrigeration system. In some embodiments, the refrigeration system receives this information from sensors 160 configured to detect load information. For example, one or more sensors 160 of the refrigeration system 100 may detect that the system load is 24 kBTU/hr. The method 1000 may then continue to step 1020.

At step 1020, the refrigeration system receives information associated with the compressors. The information associated with the compressors may comprise one of: model name, model number, total capacity, compressor efficiency, portability, drive system, and/or compressor type. In some embodiments, the information associated with the compressors may be received from one or more sensors 160 of the refrigeration system. In some embodiments, the information associated with the compressors may be loaded into memory 220 of controller 150. For example, a data map corresponding to a particular compressor 110 may be uploaded to the memory 220 of the controller 150. The data map may be predetermined by the compressor manufacturer based on information associated with the compressor. In some embodiments, the method 1000 may continue to step 1030.

At step 1030, the refrigeration system determines, based on the information associated with the compressors, a first efficiency value associated with allocating the load among one or more of the compressors according to a first compressor staging. In some embodiments, the first efficiency value is determined using a data map. The data map may comprise one or more equations used to calculate the efficiency of a compressor 110. For example, based on known and measured properties of a compressor 110, the refrigeration system may calculate the efficiency of the compressor to be 70%. In some embodiments, the calculated efficiency value may be associated with the operation of the compressor according to a first compressor staging.

In other embodiments, the first efficiency value corresponds to a saved value determined from feedback obtained during previous operation of the compressors according to the first compressor staging. For example, the first compressor staging may include distributing a 24 kBTU/hr load to compressors 110*a* and 110*b*. The refrigeration system may determine that the first efficiency value associated with this compressor staging is 70%. The refrigeration system may then save the determined efficiency value to memory. In a subsequent operation of the refrigeration system, the refrigeration system may determine that it is operating according to the first compressor staging (e.g., distributing a 24 kBTU/hr load to compressors 110*a* and 110*b*) and receive the first efficiency value (i.e., 70%) from memory. Thus, the refrigeration system may determine that the overall system efficiency is 70% when the compressors distribute the system load according to the first compressor staging. In some embodiments, the method 1000 may continue to step 1040.

At step 1040, the refrigeration system determines, based on information associated with the compressors, a second efficiency value associated with allocating the load among one or more the compressors according to a second compressor staging. For example, the refrigeration system may determine that the overall system efficiency is 85% when the compressors distribute the system load according to the second compressor staging. The second efficiency value may be determined similarly to the first efficiency value. For example, in some embodiments, the second efficiency value may be determined using a data map. In other embodiments, the second efficiency value may be determined using a saved value determined from feedback obtained during a previous operation of the refrigeration system. In some embodiments, the method 1000 continues to step 1050.

At step 1050, the refrigeration system determines whether the efficiency value of the first compressor staging (also referred to as the first efficiency value) is more efficient than the efficiency value of the second compressor staging (also referred to as the second efficiency value). In some embodiments, determining whether the efficiency value of the first compressor staging is more efficient than the efficiency value of the second compressor staging is based on a comparison of the first and second efficiency values. For example, the refrigeration system may determine that second efficiency value is more efficient than the first efficiency value when the efficiency value of the first compressor staging is 70% and the efficiency value of the second compressor staging is 85%. In response to determining which compressor staging is more efficient, refrigeration system may operate the compressors accordingly at step 1060.

At step 1060, refrigeration system operates the compressors based on the more efficient compressor staging determined in step 1050. In some embodiments, refrigeration system may operate the compressors with the load allocated according to the first compressor staging if the first efficiency value is more efficient than the second efficiency value (see e.g., step 1060*a*). In other embodiments, refrigeration system may operate the load allocated according to the second compressor staging if the second efficiency value is more efficient than the first efficiency value (see e.g., step 1060*b*). As depicted in FIG. 10, the refrigeration system continues from step 1050 to either step 1060*a* or 1060*b*. At step 1060*a*, the refrigeration system operates according to the first compressor staging when the first efficiency value is determined to be more efficient than the second efficiency value. Alternatively, at step 1060*b*, the refrigeration system operates according to the second compressor staging when the second efficiency value is determined to be more efficient than the first efficiency value. In some embodiments, the method 1000 may continue to an end step 1065.

In other embodiments, the method 1000 may comprise one or more additional steps. For example, it may be beneficial for the refrigeration system to recalibrate after detecting a change in the refrigeration system. Thus, the method 1000 may further include updating the data map in response to identifying a change to one or more of the compressors 110. For example, refrigeration system 100 may identify that compressor 110*a* has stopped working. In response, refrigeration system 100 may update the data map to reflect that compressor 110*a* has stopped working so that the system load may be allocated, based on efficiency, to the remaining three operable compressors (e.g., compressors 110*b-d*). In this manner, refrigeration system 100 operates its operable compressors 110*b-d* at (adjusted) maximum efficiency by staging the compressors accordingly.

In some embodiments, the refrigeration system may use feedback to determine the most efficient combination of compressors. In such an embodiment, the refrigeration system may operate the compressors in a plurality of combinations, measure the efficiency of the refrigeration system for each combination, and save a particular combination in response to determining that the refrigeration system is operating more efficiently than the other combinations. For example, the refrigeration system may operate the compressors in various combinations (e.g., combination one: compressors 110*a*, 110*c*; combination two: compressors 110*a*, 110*b*, 110*d*; combination three: compressors 110*a*, 110*b*, 110*c*, 110*d*). At each combination, the refrigeration system may measure the efficiency (e.g., combination one: 72%; combination two: 68%; combination three: 78%). In response to determining that the refrigeration system is operating more efficiently given a particular combination than at other combinations, the refrigeration system may save the particular combination (e.g., refrigeration system may save combination three to memory because it yields the most efficient combination (78%) of the three combinations).

This disclosure also recognizes improving the efficiency of a refrigeration system by performing compressor diagnostics. Generally, to maintain such cool temperatures, refrigeration systems typically include one or more compressors configured to compress refrigerant running through the refrigeration system. Because compressors play a vital role in maintaining a cool environment, compressor reliability may be of concern to both manufacturers and owners of refrigeration systems. For example, a defective compressor in a grocery store may lead to costs associated with repairing or replacing the defective compressor, or in worse cases, to food spoilage, damages liability, and lost profits. Thus, this disclosure recognizes that an owner of a refrigeration system may benefit from early detection of compressor defects. Accordingly, there exists a need for a refrigeration system that is configured to detect possible deficiencies or defects of compressors by performing diagnostics.

Figure 4:
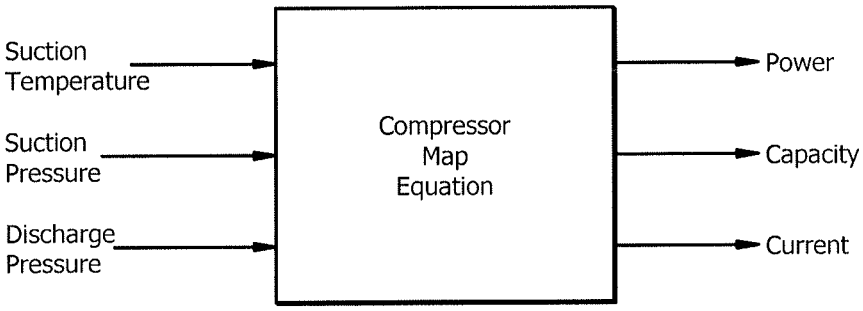
FIG. 4 is a block diagram illustrating an example method of determining outputs associated with the refrigeration system of FIG. 1 using a compressor map equation, according to certain embodiments.

Manufacturers of refrigeration systems typically provide compressor maps associated with their compressor models. A compressor map typically includes data and equations associated with a particular compressor model. This disclosure recognizes using the information from compressor maps in an analytics routine to determine when compressors 110 may be under or over-performing. For example, as depicted in FIG. 4, a compressor map equation may be used to calculate mass flow, power, and current of compressor 110 by inputting refrigeration system information (e.g., suction pressure, suction temperature, and discharge pressure). Such refrigeration system information may be received by refrigeration system 100. For example, refrigeration system 100 may receive refrigeration system information using a plurality of sensors 160. Sensors 160 may be configured to sense data related to suction temperature, suction pressure, discharge pressure, current, and capacity of compressors 110.

Figure 5A:
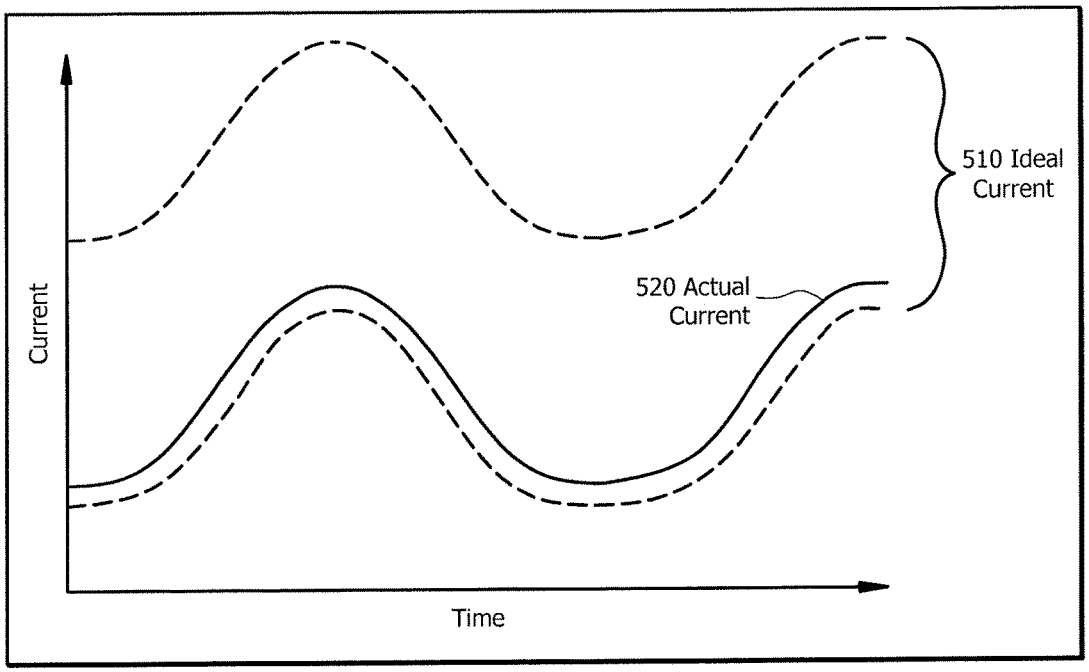
FIGS. 5A-5B are example graphs illustrating compressor diagnostics of the refrigeration system of FIG. 1, according to certain embodiments.
Figure 5B:
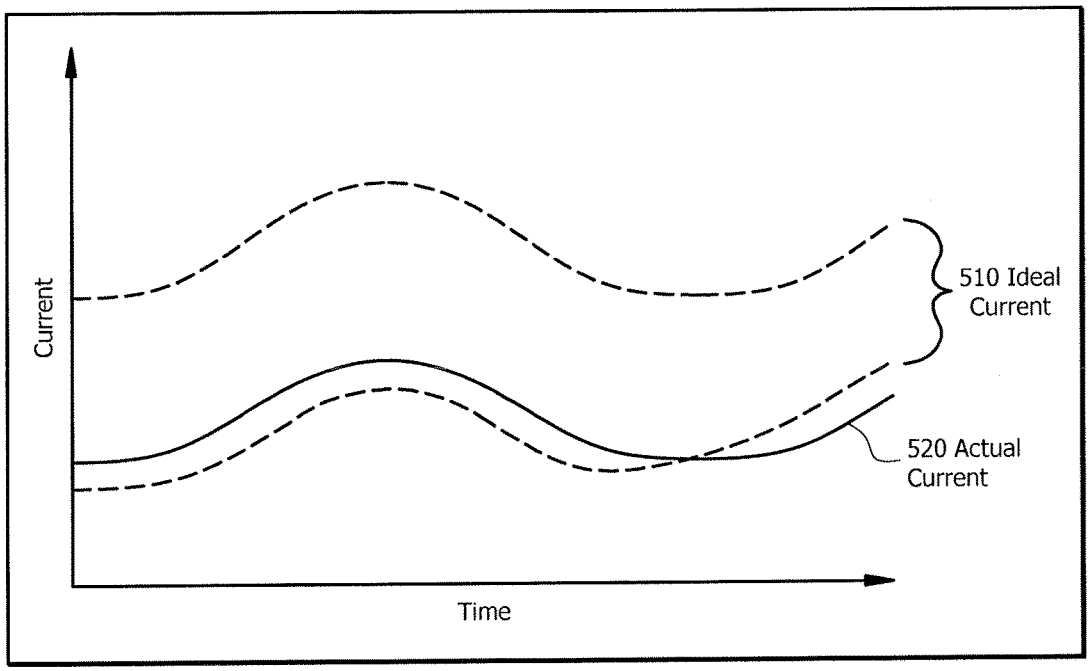

In some embodiments, controller 150 is configured to detect deficiencies in compressor 110 using values associated with a compressor current. For example, as depicted in FIGS. 5A and 5B, based on inputting values associated with suction temperature, suction pressure, and discharge pressure, controller 150 may calculate a range of values representing the "ideal" current 510 of compressor 110. As shown in FIGS. 5A and 5B, current fluctuates throughout the day, for example, depending on the outdoor temperature. In the abstract, it may be difficult to determine whether the fluctuation is good or bad. Certain embodiments may allow for determining whether such a fluctuation is good or bad.

As one example, example, controller 150 may compare the actual current measurement 520 (sensed by current sensor 160) to the "ideal" current range 510. In some embodiments, detection of an actual value 520 inside the "ideal" range 510 may indicate that compressor 110 is in good operating condition (e.g., FIG. 5A). Detection of an actual value 520 outside of the "ideal" range 510 may indicate that compressor 110 is deficient and/or defective (e.g., FIG. 5B). In some embodiments, refrigeration system 100 is configured to trigger an alarm if the actual current measurement 520 is outside of the "ideal" current range 510 (i.e., if controller 150 detects a possible deficiency).

As another example, controller 150 may determine whether a fluctuation is good or bad by analyzing the trend of the delta between actual current and ideal current. For example, controller 150 may determine that a fluctuation is good when the trend of the delta becomes smaller over time. On the other hand, controller 150 may determine that a fluctuation is bad when the trend of the delta becomes greater over time. In some embodiments, controller 150 may trigger an alarm if the trend of the delta increases for a specified period of time (i.e., indicating a possible defect or deficiency).

In some embodiments, the ideal range 510 may comprise more than one value (e.g., a low value corresponding to the minimum value of the ideal range and a high value corresponding to the maximum value of the ideal range). In other embodiments, the ideal range 510 may be a single value associated with a deviation band. For example, controller 150 may calculate an ideal maximum capacity range of 15 kBTU/hr with a 3σ standard deviation band. In some embodiments, deviation bands may be pre-programmed into memory 220 of controller 150. In other embodiments, deviation bands may be learned by controller 150 through operation of HVAC system 100.

In some embodiments, the ideal range 510 is fixed. In other embodiments, the ideal range 510 may be variable. For example, the ideal range 510 may be changed remotely (e.g., via an update from the manufacturer). As another example, the ideal range 510 may be changed by the operator of the HVAC system 100. This disclosure recognizes that the ideal range 510 may be adjusted to be broader or narrower. In some embodiments, the ideal range 510 is adjusted based on operator preferences. In other embodiments, the ideal range 510 is adjusted based on sensitivity of the algorithm.

A similar method could be used to compare actual power to ideal power. Alternatively, current may be used as a proxy for power due to the relationship between current and power (e.g., P=IV).

In other embodiments, controller 150 is configured to detect deficiencies in compressor 110 using values associated with capacity. For example, based on inputting values associated with suction temperature, suction pressure, and discharge pressure, controller 150 may calculate a range of values representing the "ideal" capacity of compressor 110. Controller 150 may then compare the actual capacity measurement (sensed by capacity sensor) to the "ideal" capacity range. Detection of an actual capacity measurement outside of the "ideal" capacity range may indicate that compressor 110 is deficient and/or defective. In some embodiments, refrigeration system 100 is configured to trigger an alarm if the actual capacity measurement is outside of the "ideal" capacity range (i.e., if controller detects a possible deficiency).

In some embodiments, refrigeration system 100 may be configured to trigger an alarm indicating a deficiency based on a reserve measurement. As used herein, reserve measurement refers to the difference between a value associated with the ideal input variable and the actual measured value sensed by sensor. In some embodiments, the value associated with the ideal input variable may be the maximum value of the calculated "ideal" range. In other embodiments, the reserve measurement may be calculated using the minimum value of the calculated "ideal" range. As an example, refrigeration system 100 may be configured to monitor capacity of compressor 110 and trigger an alarm if the amount of capacity in reserve is less than a threshold.

For example, controller 150 may calculate an "ideal" maximum capacity value (using the inputs and compressor map equation discussed above) to be 18 kBTU/hr and receive an actual measurement of capacity from capacity sensor of 12 kBTU/hr.

In such example, the reserve measurement would be 6 kBTU/hr if calculated using the maximum value of the "ideal" range.

Controller 150 may be configured to trigger an alarm indicating deficiency if the reserve measurement is less than a specified value. For example, controller 150 may be configured to trigger an alarm if the reserve measurement is less than 4 kBTU/hr. Because the reserve measurement in the above example (6 kBTU/hr) is greater than the specified value (4 kBTU/hr), controller 150 will not trigger an alarm. However, if the reserve capacity is 2 kBTU/hr which is less than the 4 kBTU/hr threshold, an alarm will be triggered indicating that there may be a defect with compressor 110 and/or that additional capacity may be required.

Figure 12:
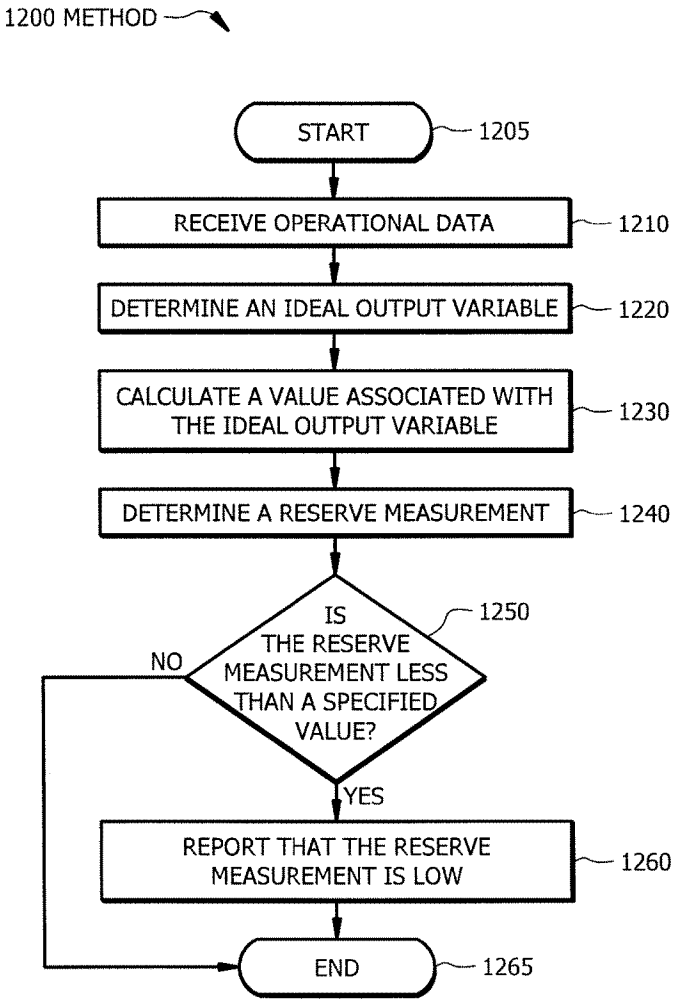
FIG. 12 is a flow diagram illustrating another example method of detecting defects or deficiencies in the refrigeration system of FIG. 1, according to one embodiment of the present disclosure.
Figure 11:
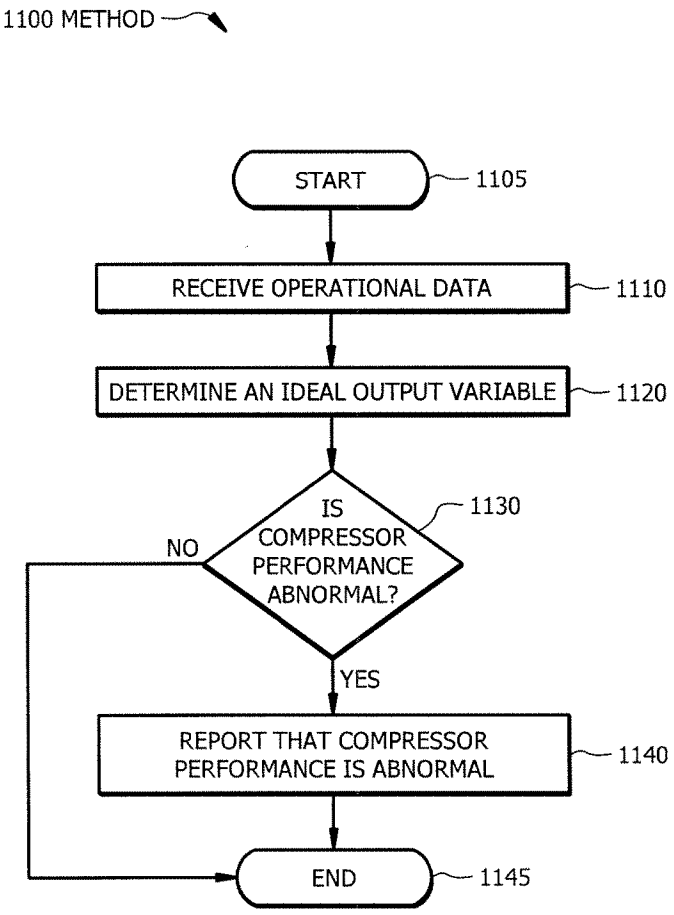
FIG. 11 is a flow diagram illustrating an example method of detecting defects or deficiencies in the refrigeration system of FIG. 1, according to one embodiment of the present disclosure.

FIGS. 11 and 12 are directed to methods of detecting defects or deficiencies in a refrigeration system. The refrigeration system can be the refrigeration system of FIG. 1. A controller such as described with respect to FIGS. 1 or 2 may be used to perform the methods of FIGS. 11 and 12. The methods of FIGS. 11 and 12 may represent algorithms that are stored on a computer readable medium, such as a memory of a controller (e.g., the memory 220 of FIG. 2).

Turning now to FIG. 11, the method 1100 begins at step 1105. At step 1110, the refrigeration system receives data associated with the operation of the refrigeration system. The data associated with the operation of the refrigeration system may be one or more of suction temperature, suction pressure, discharge pressure, current, and/or capacity associated with one or more compressors of the refrigeration system. In some embodiments, the data is received by one or more sensors 160 operable to sense the suction temperature, suction pressure, discharge pressure, current, and capacity of the one or more compressors. The method 1100 may then continue to step 1120.

At step 1120, the refrigeration system determines an ideal output variable of a compressor based at least on the data associated with the operation of the refrigeration system. The ideal output variable of a compressor may be one of mass flow, power, current, and/or capacity. In some embodiments, the refrigeration system determines the ideal output variable using a compressor map equation. For example, the suction temperature, suction pressure, and/or discharge pressure received from the sensors 160 may be inputs to a compressor map equation (e.g., the compressor map equation of FIG. 4) that outputs ideal values for mass flow, power, current, and/or capacity.

In some embodiments, the refrigeration system may calculate a range of values associated with the ideal output variable by inputting the data associated with the operation of the refrigeration system (received in step 1110) into a compressor map equation. For example, as shown in FIGS. 5A and 5B, the refrigeration system may calculate a range of values representing an ideal current for the compressor (e.g., ideal current 410) based on the suction pressure, suction temperature, and discharge pressure sensed by the one or more sensors (e.g., sensors 160*b*, 160*c*, and/or 160*e*). In some embodiments, the method 1100 continues to a decision step 1130.

In decision step 1130, the refrigeration system determines, based at least on the data associated with the operation of the refrigeration system (e.g., actual values for mass flow, power, capacity, and/or current received from the sensors at step 1110) and the ideal output variable (e.g., ideal values for mass flow, power, capacity, and/or current determined in step 1120), whether the performance of the compressor is abnormal. For example, in some embodiments, the data associated with the operation of the refrigeration system is compared to a value associated with the ideal output variable to determine that the performance of the compressor is abnormal.

In some embodiments, determining that the performance of the compressor is abnormal includes determining that a value associated with the operational data is outside the range of values associated with the ideal output variable. For example, as depicted in FIG. 5B, the refrigeration system determines that a value associated with the operational data (i.e., actual current 520) is outside the range of values associated with the ideal output variable (i.e., ideal current 510).

In some embodiments, determining that the performance of the compressor is abnormal comprises determining that the compressor is under or over-performing. For example, in some embodiments, the refrigeration system may determine that the compressor is under-performing when it senses that the operational data is lower than a value associated with the ideal output variable. Alternatively, in some embodiments, the refrigeration system may determine that the compressor is over-performing when it senses that the operational data is higher than a value associated with the ideal output variable. If the refrigeration system determines that the performance of the compressor(s) is normal, the method 1100 may continue to an end step 1145. Alternatively, if the refrigeration system that the performance of the compressor is abnormal, the method 1100 may continue to step 1140.

At step 1140, the refrigeration system reports that compressor performance is abnormal. In some embodiments, reporting comprises triggering an alarm. In other embodiments, reporting comprises sending a notification or warning to the operator of the refrigeration system. Although this disclosure describes specific methods of reporting, this disclosure recognizes any suitable method of reporting that the compressor performance is abnormal. In some embodiments, method 1100 may continue to an step 1145 where the method ends.

In other embodiments, such as depicted in FIG. 12, the method 1200 may determine abnormal compressor performance based on a reserve measurement. The method 1200 may begin at step 1205 and then continue to step 1210. At step 1210, the refrigeration system receives data associated with the operation of the refrigeration system. As described above, this information may be received by one or more sensors 160 associated with the refrigeration system. The method 1200 may then continue to step 1220. At step 1220, the refrigeration system determines an ideal output variable. As described above, the ideal output variable may be one of mass flow, power, current, and/or capacity. The method 1200 may then continue to step 1230.

At step 1230, the refrigeration system calculates a value associated with the ideal output variable. In some embodiments, the value may be calculated using a compressor map equation provided by the manufacturer of a compressor. For example, a compressor map equation may be used to calculate a value associated with the ideal output variable by inputting the data associated with the operation of the refrigeration system. The method 1200 may then continue to step 1240.

At step 1240, the refrigeration system determines a reserve measurement based on a value associated with the ideal output variable and the value associated with the operational data. In some embodiments, the reserve measurement may be determined by calculating the difference between a maximum value associated with the ideal output variable and the value associated with the operational data. For example, the refrigeration system may calculate a maximum value associated with the ideal output variable for capacity as 18 kBTU/hr and receive operational data indicating that the compressor capacity is 12 kBTU/hr. In such an example, the refrigeration system may determine that the reserve measurement is 6 kBTU/hr. In other embodiments, the reserve measurement may be determined by calculating the difference between the value associated with the operational data and a minimum value associated with the ideal output variable. The method 1200 may then continue to a decision step 1250.

At decision step 1250, the refrigeration system determines whether the reserve measurement is less than a specified value. The specified value may be a value specified by the manufacturer of the compressor or by the operator of the compressor. The specified value may be stored on a computer readable medium, such as a memory of a controller (e.g., the memory 220 of FIG. 2). In some embodiments, if the refrigeration system determines that the reserve measurement is greater or equal to the specified value, the method 1200 continues to an end step 1265. Alternatively, if the refrigeration system determines that the reserve measurement is less than the specified value, the method 1200 may continue to step 1260.

At step 1260, the refrigeration system reports when the reserve measurement is less than a specified value. In some embodiments, reporting that the reserve measurement is less than a specified value comprises triggering an alarm. In other embodiments, reporting that the reserve measurement is less than a specified value comprises sending a warning to the operator of the refrigeration system. The method 1200 may then end in a step 1265.

In certain embodiments, the methods described with respect to FIGS. 11 AND 12 may be performed in parallel. For example, operational data may be used to determine if compressor performance is abnormal (as described in FIG. 11) and to determine if a reserve measurement is low (as described in FIG. 12).

This disclosure also recognizes improving the energy efficiency of a refrigeration system by prioritizing one control variable over another control variable in order to meet a control objective. Refrigeration systems may be associated with one or more control objectives that, when met, ensure that the enclosed space is maintaining its cool temperature. For example, a control objective for a refrigeration system may be to maintain a specific suction pressure, liquid pressure, liquid temperature, and/or condenser temperature difference (TD). Consequences may vary for a refrigeration system that is not meeting its control objectives. For example, failure to meet a control objective may result in damage to one or more components of the refrigeration system, an increase in energy consumption in the event that one component compensates for another component, or even an inoperable refrigeration system.

Refrigeration system 100 may be configured to send a warning to an operator when it is at risk for not meeting a control objective. In some embodiments, refrigeration system 100 may determine it is at risk for not meeting a control objective based on a statistical analysis of operating data. Control objectives may include suction pressure, liquid pressure, and liquid temperature. Control objectives may also include condenser temperature difference (TD). Although this disclosure describes specific control objectives, this disclosure contemplates controller 150 may control any control variable of refrigeration system 100. In some embodiments, control objectives may be associated with setpoints. As one example, such as that depicted in FIG. 6, the control objective for refrigeration system 100 may be to maintain suction pressure at a setpoint of 8 PSI. As another example, the control objective of refrigeration system 100 may be to maintain liquid pressure at a setpoint of 104 PSI.

Figure 6:
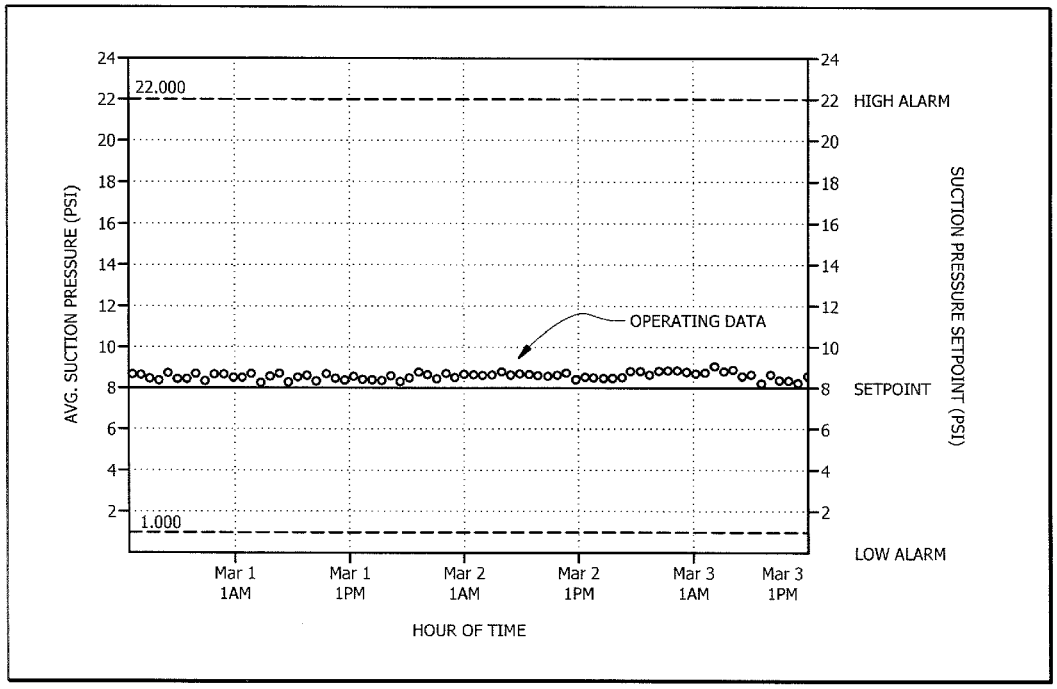
FIG. 6 is an example graph illustrating an example method of detecting whether the refrigeration system of FIG. 1 is meeting its control objective, according to certain embodiments.

Control objectives may also be associated with an acceptable range. For example, as depicted in FIG. 6, the control objective of refrigeration system 100 may be to maintain suction pressure between an acceptable range of 1-22 PSI. Thus, refrigeration system 100 would meet its suction pressure objective as long as the suction pressure remains within those limits. The upper and lower values in the range may be associated with an alarm. For example, if refrigeration system 100 senses that suction pressure is above 22 PSI, refrigeration system 100 may alert an operator.

Refrigeration system 100 may receive actual data (operating data) associated with each control variable. For example, refrigeration system may receive operating data associated with suction pressure, liquid pressure, outdoor temperature, and/or liquid temperature. Operating data may be received from one or more sensors 160 of refrigeration system 100.

Controller 150 of refrigeration system 100 may be configured to calculate a confidence interval for the control objective using the received operating data. The confidence interval may be calculated at any suitable value. As an example, controller 150 may determine a standard deviation band of 3σ at a 99% confidence interval for the entire population of operating data associated with suction pressure. In some embodiments, controller 150 may be configured to trigger a warning to operator of refrigeration system 100 when operating data begins to deviate from the band. For example, controller 150 may send a warning to operator upon detection of actual suction pressure measurements deviating higher or lower than 3σ. The standard deviation band (or acceptable range) may be determined by any suitable means. For example, the band may be predetermined by the manufacturer and the values associated with the band may be programmed in controller 150. As another example, controller 150 may learn the typical band during operation of HVAC system 100 and may be operable to detect any deviation from the band during operation (e.g., during operation of HVAC system 100, controller 150 may determine the mean of its control variable from operating data associated with the control variable and the standard deviation for the control variable and thus determine whether the HVAC system is operating outside of the band).

Figure 7:
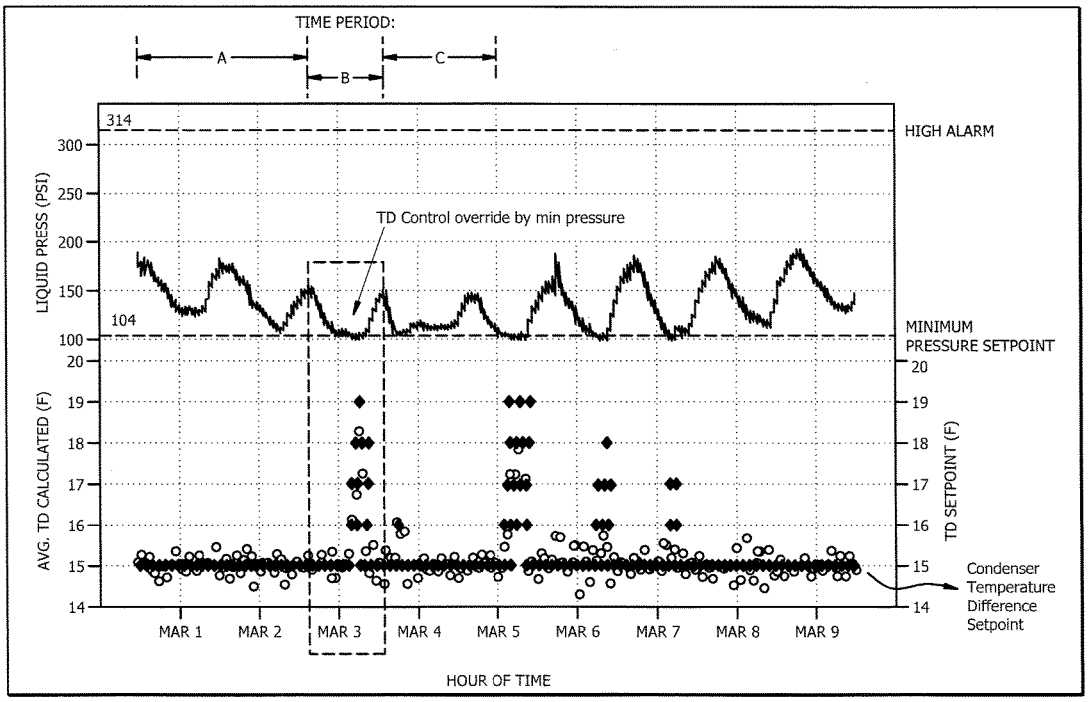
FIG. 7 is an example graph illustrating another method of detecting whether the refrigeration system of FIG. 1 is meeting its control objective, according to certain embodiments.

In some embodiments, a single control objective may be controlled by more than one controller. For example, refrigeration system 300 may include controllers 150*a* and 150*b*. Controller 150*a* may be configured to control suction pressure and liquid pressure. Controller 150*b* may be configured to control liquid pressure and temperature difference (TD). In some embodiments, a control objective of controller 150 may include control variables associated with different priorities. For example, such as depicted in FIG. 7, controller 150*b* may be configured to prioritize liquid pressure over condenser TD. As such, controller 150*b* will manually override control of condenser TD in favor of restoring liquid pressure to its acceptable range.

In FIG. 7, operational data for liquid pressure and condenser TD is depicted over a period of time. As depicted, liquid pressure is associated with an acceptable range of 104-314 PSI and condenser TD is associated with a setpoint of 15° F. At time period A, refrigeration system 100 is operating within an acceptable range such that no alarms are triggered (i.e., refrigeration system 100 is meeting all control objectives). However, at time period B, the actual measurement of liquid pressure reaches the minimum value of the acceptable range (e.g., a decrease in outdoor temperature causes a decrease in liquid pressure). In response, controller 150*b* may be configured to adjust the speed of condenser fan 125 such that liquid pressure increases. In effect, controller 150 manually overrides the condenser TD difference in favor of restoring liquid pressure to the acceptable range. At time period C, all components of refrigeration system 100 are operating within their acceptable ranges.

In certain embodiments, a controller verification method may verify that the system is acting properly. The controller verification method may ignore the value of a lower priority measurement (e.g., TD) near the time periods that a higher priority measurement (e.g., liquid pressure) operates outside of its acceptable range. This may prevent a false alarm. For example, in FIG. 7, TD only operates outside of its acceptable range when the liquid pressure falls to its minimum value. Thus, even though TD is occasionally outside of its acceptable range, the system is operating properly because maintaining liquid pressure within its acceptable range has higher priority than maintaining TD.

Figure 13:
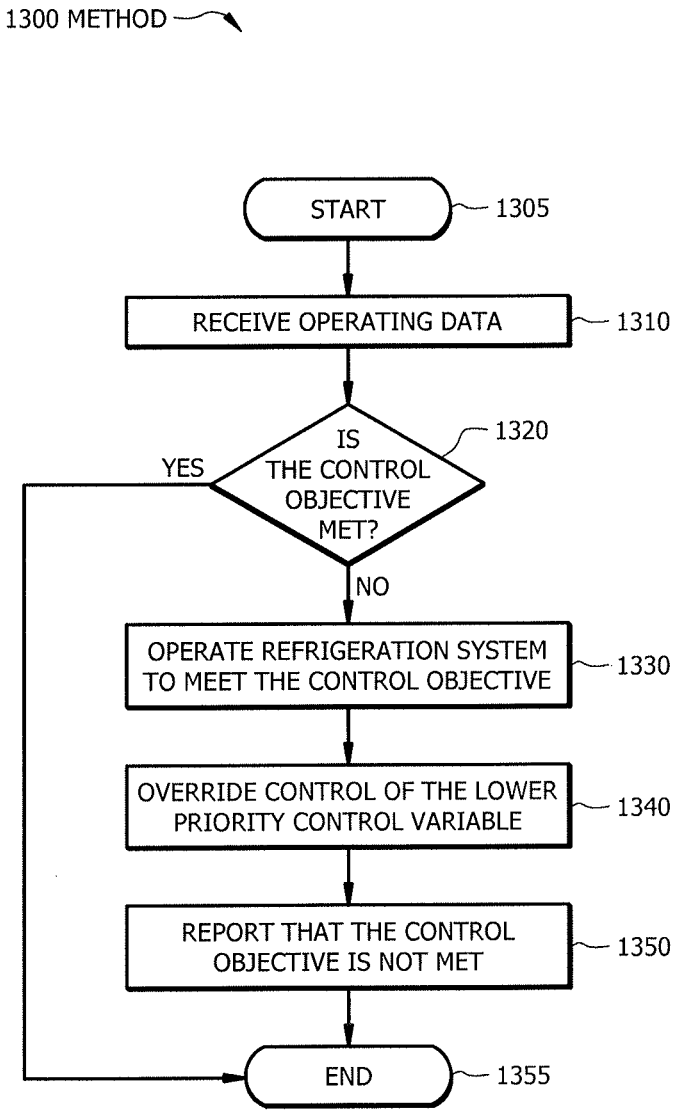
FIG. 13 is a flow diagram illustrating an example method of detecting whether the refrigeration system of FIG. 1 is meeting its control objective, according to one embodiment of the present disclosure.

FIG. 13 is directed to a method of detecting when a refrigeration system is at risk for not meeting its control objective. The refrigeration system can be the refrigeration system of FIG. 1. A controller such as described with respect to FIGS. 1 or 2 may be used to perform the method of FIG. 13. The method of FIG. 13 may represent an algorithm that is stored on a computer readable medium, such as a memory of a controller (e.g., the memory 220 of FIG. 2).

The method 1300 begins at step 1305. At step 1310, refrigeration system 100 receives operating data associated with at least one control variable.

Refrigeration system 100 may have one or more control variables such as: suction pressure, liquid pressure, liquid temperature, and/or condenser temperature difference. Refrigeration system 100 may receive operating data from sensors 160 operable to sense data associated with refrigeration system 100. For example, sensors 160 may be operable to sense data associated with suction pressure (e.g., sensor 160*b*), liquid pressure (e.g., sensor 160*a*), liquid temperature (e.g., sensor 160*a*), and/or temperature of the surrounding environment. The method 1300 may then continue to a decision step 1320.

At decision step 1320, the refrigeration system 100 determines, based on the operating data, whether a control objective is met. Refrigeration system 100 may have a control objective associated with one or more control variables. In some embodiments, the control objective of refrigeration system 100 may include one control variable. In other embodiments, the control objective of refrigeration system 100 may include more than one control variable. Although specific control variables have been described herein, this disclosure contemplates that the control objective of refrigeration system 100 may be associated with any variable that is controllable by refrigeration system 100.

In some embodiments, determining whether the control objective is met according to step 1320 comprises determining whether the refrigeration system 100's highest priority objective is met. In some embodiments, each control variable may be associated with a particular priority status. For example, the control objective of refrigeration system 100 may be to prioritize suction pressure over liquid pressure. As another example, the control objective of refrigeration system 100 may be to prioritize liquid pressure over liquid temperature. As yet another example, the control objective of refrigeration system 100 may be to prioritize suction pressure over liquid pressure but also prioritize liquid pressure over liquid temperature. In such embodiments, the control objective is met when the highest priority objective is met even though a lower priority objective may not be met.

In some embodiments, determining whether a control objective is met according to step 1320 may comprise comparing operating data associated with a control variable to an acceptable range or set point. For example, suction pressure may be associated with an acceptable range of 1-22 PSI and a setpoint of 8 PSI. As another example, liquid pressure may be associated with an acceptable range of 104-314 PSI and a setpoint of 104 PSI . As yet another example, condenser temperature difference may be associated with a setpoint of 15° F.

In some embodiments, determining whether a control objective is met according to step 1320 comprises determining whether the operating data associated with a control variable falls within the acceptable range. For example, refrigeration system 100 may determine that its control objective of maintaining suction pressure between 1-22 PSI is not met when the operating data for suction pressure is measured at 25 PSI. As another example, refrigeration system 100 may determine that its control objective is not met when the operating data associated with its higher priority control variable (e.g. suction pressure) is outside of the acceptable range for suction pressure (e.g., 1-22 PSI).

In another embodiment, determining whether a control objective is met according to step 1320 may comprise calculating a confidence interval for the control objective, determining a standard deviation band associated with the confidence interval, and comparing the operating data to the standard deviation band. For example, refrigeration system 100 may have a control objective of maintaining suction pressure at 8 PSI. Based on this control objective, refrigeration system 100 may calculate a 99% confidence interval for the entire population of operating data associated with suction pressure and determine that a standard deviation band of $3\sigma$ is associated with the calculated confidence interval. In some embodiments, refrigeration system 100 may compare operating data received from sensors 160 to the standard deviation band. In some embodiments, refrigeration system 100 determines that it is meeting its control objective when the operating data falls within the standard deviation band. In other embodiments, refrigeration system 100 determines that it is not meeting its control objective when the operating data falls outside of the standard deviation band.

If the refrigeration system determines that the control objective is met, in some embodiments, the method 1300 continues to an end step 1355. Alternatively, if the refrigeration system determines that the control objective is not met, the method 1300 may continue to step 1330.

At step 1330, refrigeration system 100 operates according to a configuration selected to cause the control objective to be met. In some embodiments, refrigeration system 100 is operated according to the configuration selected to cause the control objective to be met in response to determining that the control objective is not being met. For example, in response to determining that the operating data associated with a higher priority control variable is outside of its acceptable range, refrigeration system 100 operates according to a configuration selected to bring the operating data associated with the higher priority control variable within its acceptable range. Such an example may be better understood in view of FIG. 7.

FIG. 7 depicts an example refrigeration system (e.g., refrigeration system 100) having a control objective of prioritizing liquid pressure over condenser temperature difference. At time period B, refrigeration system 100 determines that it is at risk for not meeting its control objective (i.e., liquid pressure falls below 104 PSI) and operates refrigeration system 100 in a configuration that causes the control objective to be met. As an example, the configuration that causes the control objective to be met may comprise decreasing the speed of condenser fan 125. In some embodiments, method 1300 may continue to an end step 1355. In other embodiments, method 1300 may continue to step 1340. In yet other embodiments, method 1300 may continue to step 1350 or return to step 1305 to begin method 1300 again.

Step 1340 may be applicable when refrigeration system 100 has a control objective involving more than one control variable. At step 1340, refrigeration system 100 overrides control of a lower priority control variable until the operating data associated with the higher priority control variable is within its acceptable range. In other words, refrigeration system 100 may ignore the operating data associated with a lower priority control variable near the time periods when the operating data associated with the higher priority control variable is outside of its acceptable range.

Returning to the earlier example depicted in FIG. 7, the control objective of refrigeration system 100 may be to prioritize liquid pressure over condenser temperature difference (TD). At time period B, refrigeration system 100 may operate the condenser fan 125 at a lower speed in order to increase liquid pressure and meet its control objective. However, decreasing the speed of condenser fan 125 may result in an increased TD between the surrounding environment and the liquid refrigerant. See FIG. 7 (operating data associated with condenser TD increases during time period B). Step 1340 of method 1300 permits deviation of operating data associated with the condenser TD by overriding control of condenser TD (lower priority control variable) until liquid pressure (i.e., higher priority control variable) is restored to an acceptable value. Stated differently, refrigeration system 100 may ignore that the operating data associated with the condenser TD is deviating from its 15° F. setpoint until the operating data associated with condenser pressure reaches at least 104 PSI.

At an optional step 1350, refrigeration system 100 reports when the control objective is not being met. In some embodiments, refrigeration system 100 may send a warning to the operator of refrigeration system 100 in response to determining that the control objective is not being met. For example, refrigeration system 100 may report when operating data begins to deviate from a standard deviation band. As another example, refrigeration system 100 may report when operating data is measured outside of an acceptable range. Step 1350 may occur at any suitable time. For example, in some embodiments, step 1350 may occur subsequent to step 1320. In other embodiments, step 1350 may occur subsequent to step 1340.

In some embodiments, method 1300 may include a controller verification step. In a controller verification step, the refrigeration system may verify that controller is working properly. In some embodiments, refrigeration system verifies that the controller is working properly by monitoring the operating data of the refrigeration system. For example, in some embodiments, the controller verification logic may ignore operating data for a lower priority control variable during times when the operational data for a higher priority control variable is outside the acceptable range.

Modifications, additions, or omissions may be made to the systems, apparatuses, and methods described herein without departing from the scope of the disclosure. The components of the systems and apparatuses may be integrated or separated. Moreover, the operations of the systems and apparatuses may be performed by more, fewer, or other components. For example, refrigeration system 100 may include any suitable number of compressors, condensers, condenser fans, evaporators, valves, sensors, controllers, and so on, as performance demands dictate. One skilled in the art will also understand that refrigeration system 100 can include other components that are not illustrated but are typically included with refrigeration systems. Additionally, operations of the systems and apparatuses may be performed using any suitable logic comprising software, hardware, and/or other logic. As used in this document, "each" refers to each member of a set or each member of a subset of a set.

Modifications, additions, or omissions may be made to the methods described herein without departing from the scope of the disclosure. The methods may include more, fewer, or other steps. Additionally, steps may be performed in any suitable order. In certain embodiments, the methods may be performed in parallel (e.g. methods depicted in FIGS. 11 and 12).

Although this disclosure has been described in terms of certain embodiments, alterations and permutations of the embodiments will be apparent to those skilled in the art. Accordingly, the above description of the embodiments does not constrain this disclosure. Other changes, substitutions, and alterations are possible without departing from the spirit and scope of this disclosure.

The invention claimed is:

1. A refrigeration system, the refrigeration system comprising:

one or more compressors configured to compress refrigerant circulating through the refrigeration system;

a condenser comprising at least one fan, the at least one fan configured to provide cooling to the refrigerant;

a valve configured to control the flow of the refrigerant into an evaporator, wherein:

the refrigerant has an associated liquid setting comprising a first temperature and a first pressure at which the refrigerant flows through the valve, and the initial liquid setting satisfies a load of the refrigeration system;

a controller operable to:

determine an adjusted liquid setting that satisfies the load of the refrigeration system, the adjusted liquid setting comprising a second temperature and a second pressure selected to improve energy efficiency under conditions currently being experienced by the refrigeration system, wherein the adjusted liquid setting is determined by determining a speed of the at least one fan and a discharge pressure of the one or more compressors that results in a decrease in power usage of the refrigeration system relative to the power usage of the refrigeration system operating according to the initial liquid setting; and operate the at least one fan at the determined speed and the one or more compressors at the determined discharge pressure to realize the second temperature and second pressure of the adjusted liquid setting, wherein operation of the at least one fan at the determined speed and operation of the one or more compressors at the determined discharge pressure does not change the openness of the valve.

2. The refrigeration system of claim 1, wherein the conditions currently being experienced by the refrigeration system comprise an outdoor temperature.

3. The refrigeration system of claim 1, wherein the temperature of the refrigerant and the pressure of the refrigerant are adjusted by the same proportion.

4. The refrigeration system of claim 1, the controller further operable to save the adjusted liquid setting as an optimal liquid setting for the conditions currently being experienced by the refrigeration system in response to feedback indicating that the adjusted liquid setting is more energy efficient than the original liquid setting.

5. The refrigeration system of claim 1, wherein:

the controller comprises a storage device; and the controller is further operable to:

save, to the storage device, the adjusted liquid setting as an optimal liquid setting for the conditions currently being experienced by the refrigeration system; and subsequently, in response to a detection of the saved conditions, obtain the adjusted liquid setting from the storage device and operate the refrigeration system according to the adjusted liquid setting.

6. The refrigeration system of claim 1, wherein the pressure associated with the adjusted liquid setting is selected such that the valve maintains its same amount of openness when the temperature associated with the adjusted liquid setting is lower than the temperature associated with the original liquid setting.

7. The refrigeration system of claim 1, wherein the controller is further operable to select the adjusted liquid setting in response to receiving data indicative of an outdoor temperature.

* * * * *